US005930918A

United States Patent [19]

Healy et al.

[11] Patent Number: 5,930,918

[45] Date of Patent: Aug. 3, 1999

[54] SHOE WITH DUAL CUSHIONING COMPONENT

[75] Inventors: John Healy, Madbury, N.H.; Jeff Thompson, Medford, Mass.; Tom DiSilvio, Newton, Mass.; Mary-Patricia Adamo, Wakefield, Mass.

[73] Assignee: Converse Inc., North Reading, Mass.

[21] Appl. No.: 08/972,496

[22] Filed: Nov. 18, 1997

[51] Int. Cl.[6] ..... A43B 13/20

[52] U.S. Cl. ..... 36/29; 36/25 B

[58] Field of Search ..... 36/88, 93, 29, 36/28, 35 B

[56] References Cited

U.S. PATENT DOCUMENTS

| | | |
|---|---|---|
| 4,342,157 | 8/1982 | Gilbert . |
| 4,472,890 | 9/1984 | Gilbert . |
| 4,657,716 | 4/1987 | Schmidt . |
| 4,768,295 | 9/1988 | Ito . |
| 4,817,304 | 4/1989 | Parker et al. . |
| 4,934,072 | 6/1990 | Fredericksen et al. . |
| 5,025,575 | 6/1991 | Lakic . |
| 5,042,100 | 8/1991 | Bar et al. . |
| 5,067,255 | 11/1991 | Hutcheson . |
| 5,097,607 | 3/1992 | Fredericksen . |
| 5,131,174 | 7/1992 | Drew et al. . |
| 5,203,793 | 4/1993 | Lyden . |

*Primary Examiner*—Ted Kavanaugh
*Attorney, Agent, or Firm*—Howell & Haferkamp, LC

[57] ABSTRACT

A shoe of the present invention comprises a sole, a flexible bladder, and a cushioning material. The sole has a recess configured to receive the flexible bladder. The flexible bladder has interior surface portions defining at least one chamber. The chamber includes a first region and a second region. A cushioning material occupies the first region and a compressible fluid occupies the second region. The compressible fluid provides a primary elastic response to an external pressure applied to an external surface of the bladder through compression of the compressible fluid. The cushioning material, elastically deformable but generally incompressible, provides a secondary elastic response to the external pressure applied to the external surface of the bladder through elastic deformation of the cushioning material. A method of the present invention comprises forming a shoe sole having a recess therein, providing a flexible bladder having interior surface portions defining an interior volume, placing an amount of fluid which is curable to an elastomeric solid condition into the interior volume of the bladder, and allowing the fluid to cure to said elastomeric solid condition.

19 Claims, 2 Drawing Sheets

SHOE WITH DUAL CUSHIONING COMPONENT

BACKGROUND OF THE INVENTION

This invention relates to shoes and methods for making shoes having cushions in their soles. The shoe construction of the invention is preferably employed in athletic shoes, but may be employed in various other types of shoes as well.

A typical athletic shoe includes an outsole, a midsole overlying the outsole, and an upper secured to the midsole. The midsole is generally made of a resilient foam material, such as ethylene vinyl acetate (EVA) or polyurethane (PU), which provides at least some cushioning and support to the athlete's foot. Some midsoles have recesses formed therein for containing resilient pads or fluid filled bladders. Fluid filled bladders are frequently positioned in the heel areas of shoe soles since, in a normal walking or running gait, the heel area of the foot usually strikes the ground first at each footfall. However, fluid filled bladders or cushioning pads may be positioned in other areas of the shoe and shoe sole that accept significant external forces during use.

Many prior art fluid filled bladders have been filled with a gas, such as air, while others have been filled with liquids or viscous gels. Air filled bladders provide good shock absorption of relatively light external loads through compression of the air. As the air compresses, the resistance of the bladder increases. However, one disadvantage of prior art air filled bladders is that they fail to provide adequate shock absorption in response to extreme external forces. Under extreme loads, the walls of air filled bladders have a tendency to "bottom out" against one another. Thus, there is a need for a cushioning component that provides good shock absorption in response to light external loads, and which is capable of accepting extreme external loads without "bottoming out."

Another disadvantage of prior art air filled bladders is that they have a tendency to lose air. The typical plastic bladder allows some permeation of air. When a higher air pressure exists on the inside of the bladder, which is usually the case during normal loading of the shoe sole, the air contained within the bladder tends to leak through the bladder walls over time. Also, any rupture of the bladder due to fatigue or puncture results in a total loss of cushioning through compression of the air. In an effort to prevent the leakage of air, liquid or gel, some prior art fluid filled bladders have been made with thickened plastic bladders. However, this tends to make the bladder undesirably stiff and heavy, thereby increasing the stiffness and weight of the shoe.

SUMMARY OF THE INVENTION

It is an object of the present invention to provide a shoe and a method for making a shoe having an improved cushion in a recess of the shoe's midsole. Another object is to provide a shoe and a method for making a shoe in which the cushion provides excellent cushioning, shock absorption, and energy return in response to light external loads as well as extreme external loads. Yet another object is to provide a cushion having the shock absorption of an air-filled bladder but which does not "bottom out" when subjected to extreme external loads. A further object is to provide a fluid-filled bladder configured to resist leakage of fluid therefrom even if the bladder is punctured. Another object is to provide a cushion which does not appreciably degrade in effectiveness over time. Still another object is to provide a shoe and a method for making a shoe in which the cushion is configured to provide two forms of shock absorption in response to external forces resulting from footstep impact. Yet another object is to provide a shoe which is an improvement over conventional shoe constructions.

In general, a shoe of the present invention comprises a sole, a flexible bladder, and a cushioning material. The sole has a recess configured to receive the flexible bladder. The flexible bladder has interior surface portions defining at least one chamber. The chamber includes a first region and a second region. The cushioning material is formed from a curable fluid which has cured to an elastomeric solid condition, and occupies at least the first region of the chamber. Preferably, the chamber is a closed chamber and the second region is occupied by a compressible fluid.

In another aspect of the shoe of the present invention, a liner of cushioning material lines interior surface portions of a flexible bladder. The liner of cushioning material completely defines at least one cavity within the bladder which is occupied by a compressible fluid.

In still another aspect of the shoe of the present invention, a flexible bladder has interior surface portions defining at least one chamber. The chamber includes a first region and a second region. A cushioning material occupies the first region and a compressible fluid occupies the second region. The compressible fluid provides a primary elastic response to an external pressure applied to an external surface of the bladder through compression of the compressible fluid. The cushioning material provides a secondary elastic response to the external pressure applied to the external surface of the bladder through elastic deformation of the cushioning material. The compressible fluid provides a first degree of elastic response to a first degree of external pressure applied to the external surface of the bladder and, if the external pressure is high enough, the cushioning material provides a second degree of elastic response.

Generally, a method of the present invention is for making a shoe having a sole, a flexible bladder for the sole, and a cushioning material within the flexible bladder. The method comprises forming a shoe sole having a recess therein; placing a flexible bladder into the recess of the shoe sole, the bladder having interior surface portions defining an interior volume; placing an amount of fluid which is curable to an elastomeric solid condition into the interior volume of the bladder; and allowing the fluid to cure to said elastomeric solid condition.

Other objects and features will be in part apparent and in part pointed out hereinafter.

BRIEF DESCRIPTION OF THE DRAWINGS

Reference characters in the written specification indicate corresponding parts throughout the several views of the drawings.

DETAILED DESCRIPTION OF THE PREFERRED EMBODIMENTS

Figure 1:
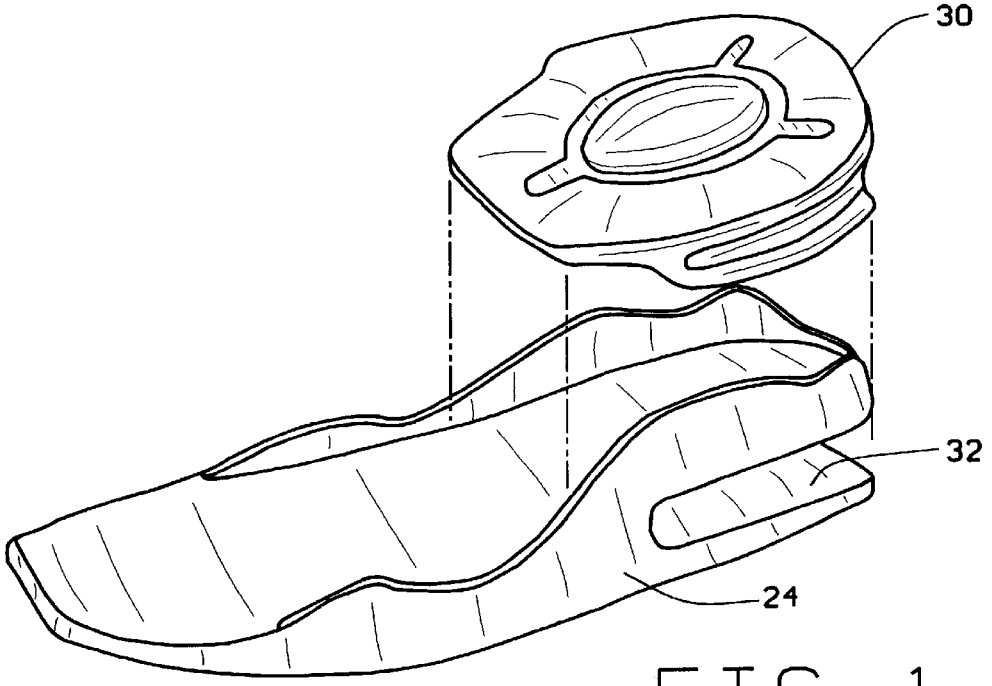
FIG. 1 an exploded perspective view of a midsole of a show of the present invention, the midsole having a recess configured for receiving a cushioning component used in the present invention.
Figure 2:
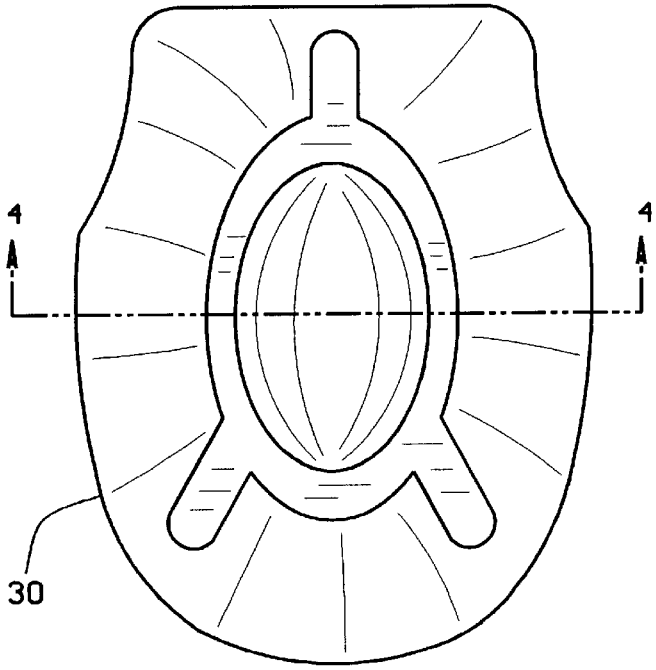
FIG. 2 is a top plan view of the cushioning component of FIG. 1.
Figure 3:
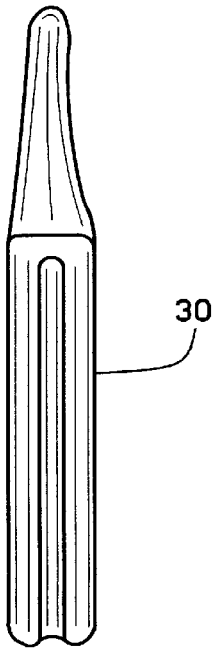
FIG. 3 is a side elevational view of the cushioning component of FIG. 2.
Figure 5:
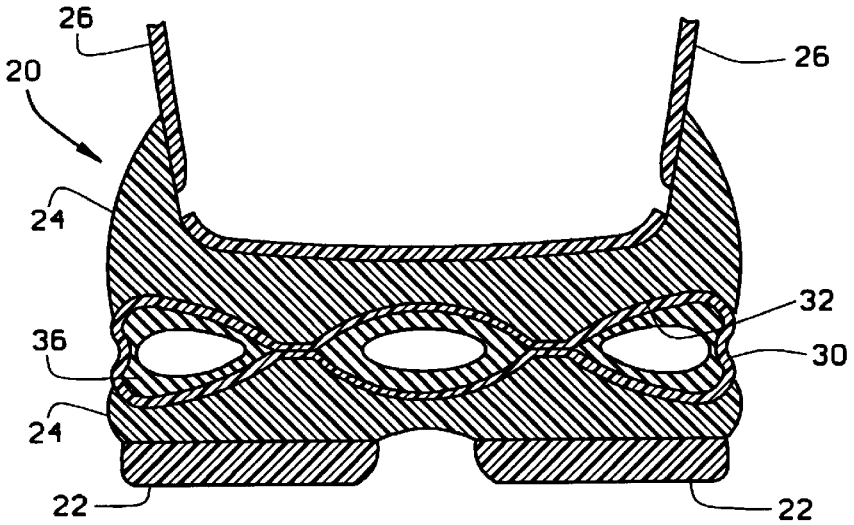
FIG. 5 is a fragmented vertical cross-sectional view similar to that of FIG. 4, but showing the cushioning component positioned within a recess of a midsole as used with a shoe of the present invention.

A shoe of the present invention is represented in its entirety by the reference numeral 20 (see FIG. 5). The shoe 20 includes an outsole 22, a midsole 24 overlying the outsole 22, an upper 26 secured to the midsole, and a cushioning component 30 adjacent to the midsole 24. As shown in FIG. 1, the midsole 24 includes a recess 32 sized to receive the cushioning component 30. In FIG. 1, the recess 32 is shown in the heel area of the midsole 24. However, it is to be understood that a cushioning component may have other configurations and may be positioned in other areas of the midsole or shoe without departing from the scope of the present invention as defined by the claims.

Figure 4:
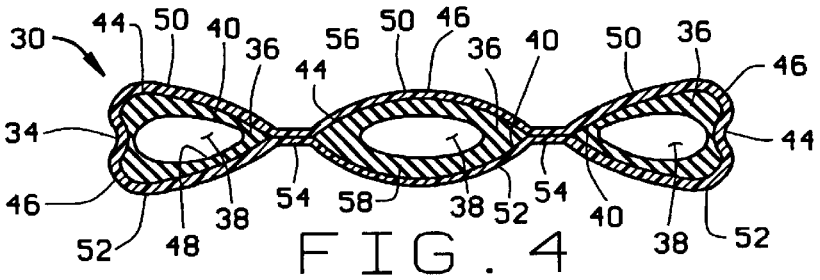
FIG. 4 is a vertical cross-sectional view of the cushioning component taken along the plane of line 4—4 of FIG. 2 and showing a liner of cushioning material lining interior surface portions of the bladder.

As best shown in FIG. 4, the cushioning component 30 comprises a flexible bladder 34, a cushioning material 36, and a compressible fluid 38. Preferably, the bladder 34 is formed from blow molded or thermo-formed polymeric material. Preferred polymeric materials include thermoplastic urethane (TPU), polyvinyl chloride (PVC), and ethyl vinyl acetate (EVA). However, the bladder 34 could be formed from other materials without departing from the scope of this invention. Generally, the configuration of the bladder 34 will match the anatomy of a portion of a human foot (not shown). The specific configuration will vary depending on the area of a shoe in which the bladder is to be placed.

Figure 6:
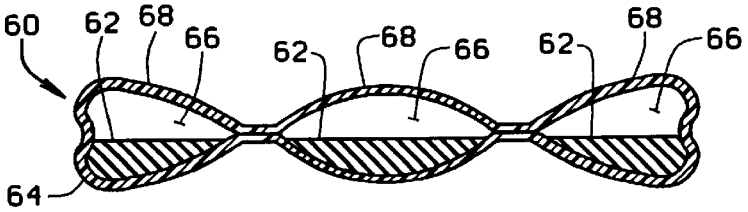
FIG. 6 is a cross-sectional view similar to that of FIG. 4, but showing an alternative embodiment of a cushioning component wherein the cushioning material occupies bottom portions of the chamber.
Figure 7:
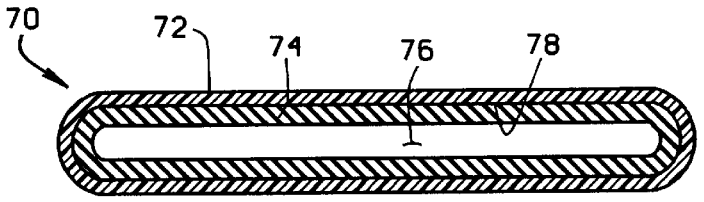
FIG. 7 is a cross-sectional view similar to that of FIGS. 4 and 6, but showing another alternative embodiment of a cushioning component having an undivided chamber.
Figure 8:
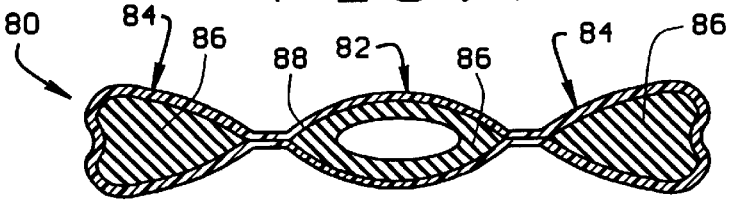
FIG. 8 is a cross-sectional view similar to that of FIGS. 4, 6 and 7, but showing still another alternative embodiment of a cushioning component wherein lateral portions of the chamber are substantially filled with the cushioning material.

The flexible bladder 34 is generally fluid impervious and has interior surface portions 40 defining at least one chamber. The cushioning material 36 occupies a first region of the chamber and the compressible fluid 38 occupies a second region of the chamber. In FIG. 4, the cushioning material 36 is shown in the form of a liner 44 which lines the interior surface portions 40 of the flexible bladder 34. FIGS. 6–8 show other configurations of the cushioning material. The liner 44 shown in FIG. 4 and the configurations of the cushioning material shown in FIGS. 6–8 will be discussed in more detail below.

The cushioning component 30 provides shock absorption through compression of the compressible fluid 38. As the compressible fluid 38 compresses, the fluid pressure within the flexible bladder 34 increases and the resistance of the cushioning component 30 to external forces applied to an external surface 46 of the bladder 34 increases correspondingly. Preferably, the compressible fluid 38 is air. However, other compressible liquid or gaseous fluids could be used without departing from the scope of the invention.

The cushioning material 36 is formed from a curable fluid which has cured to an elastomeric solid condition. Preferably, the cushioning material 36 is formed of a solid material which is elastically deformable, but generally incompressible. Although the shape of the cushioning material 36 is deformable under load, its volume does not substantially change. Therefore, the cushioning component 30 will not "bottom out," (i.e., opposing bladder walls will not come into contact with one another) even under extreme loading conditions. This protects the shoe wearer from high pressure impacts. Although it is preferable to use a material which is generally incompressible, closed or open cell foam materials could comprise the solid cushioning material even though they may not be incompressible.

In the preferred embodiment, the cushioning material 36 is formed of a curable liquid polyurethane which has cured to an elastomeric solid condition. The elastomeric solid material provides cushioning and shock absorption due to its softness. In forming the cushioning component 30, the curable fluid preferably starts as a mixture of two fluids: a polymer and a catalyst. As the two fluids are mixed together, a chemical reaction occurs and, after a short period of time elapses, an elastomeric solid forms. The actual time necessary for the curable fluid to cure will vary depending on the mixing ratio of the polymer and catalyst. Typically, the reaction occurs in between about 5 and 20 minutes. This relatively slow reaction time allows the curable fluid to be molded and shaped to various configurations as it cures to a solid form. Once cured, the elastomeric solid will preferably have a durometer hardness of between about 45 Shore 000 and 55 Shore 000. More preferably, the elastomeric solid will have a durometer hardness of about 50 Shore 000. However, depending on the particular needs of the shoe wearer, a curable fluid can be developed which results in a cured solid having other hardness characteristics.

Preferably, the liner 44 of cushioning material 36 lines the interior surface portions 40 of the flexible bladder 34 and has an inner surface 48 which envelopes the second region. In the embodiment shown in FIG. 4, the liner 44 of cushioning material 36 completely closes and defines the second region. Because the soft, elastomeric cushioning material 36 completely closes the second region, it serves as a plug to prevent leakage in the event the bladder is punctured. The cushioning material 36 also decreases the diffusion rate of air across the bladder wall, thus maintaining the internal bladder pressure. Preferably, the liner 44 has a thickness of between about 0.5 to about 1.5 millimeters. More preferably, the liner 44 has a thickness of about 1.0 millimeters. However, the thickness can be varied depending on the particular needs of the shoe wearer without departing from the scope of the invention. In some instances, it may be preferable to vary the thickness of the liner even within the same chamber.

The flexible bladder 34 includes a top wall 50 and a bottom wall 52 and, as shown in FIGS. 2, 4–6 and 8, preferably has a plurality of chambers defined by welds 54 connecting the top wall 50 to the bottom wall 52.

In use, the cushioning component 30 provides two stages of cushioning and shock absorption. The compressible fluid 38 provides a primary elastic response to an external pressure applied to the external surface 46 of the flexible bladder 34 through compression of the compressible fluid 38. The cushioning material 36 provides a secondary elastic response to the external pressure. Under relatively light external loading conditions the primary elastic response provided by the compressible fluid 38 may be sufficient. However, under more extreme loading conditions, compression of the compressible fluid 38 alone may not provide sufficient cushioning and shock absorption. Accordingly, under more extreme loading conditions, the cushioning material 36 will provide a secondary elastic response to the external pressure.

As discussed above, a liner 44 of the cushioning material 36 lines the interior surface portions 40 of the flexible bladder 34 and envelops the compressible fluid 38. The liner 44 includes opposed top and bottom portions 56 and 58 which line the top and bottom walls 50 and 52 of the bladder 34. Therefore, in the embodiments shown in FIGS. 4, 5 and 7, the liner 44 provides the secondary elastic response when the opposed top and bottom portions 56 and 58 of the liner 44 come into contact with one another.

FIG. 6 shows an alternative embodiment of a cushioning component 60 of the present invention wherein an amount of cushioning material 62 occupies bottom portions of a flexible bladder 64, rather than lining substantially all of the interior surface portions of the bladder. However, the cushioning component 60 of this embodiment functions similarly to the embodiments shown in FIGS. 4, 5 and 7. As the flexible bladder 64 flexes in response to external loading conditions, a compressible fluid 66 provides a primary elastic response through compression of the compressible fluid 66. Under higher external loading conditions, the cushioning material 62 occupying the bottom portions of the bladder 64 provide a secondary elastic response when the unlined top wall 68 of the bladder 64 comes into contact with the cushioning material 62 occupying the bottom portions of the bladder 64. This embodiment is similar to the embodiment shown in FIGS. 4 and 5 in all other respects.

FIG. 7 shows another alternative embodiment of a cushioning component 70 having an undivided chamber. Similar to the embodiment of FIG. 4, this embodiment includes a flexible bladder 72, a cushioning material 74, and a compressible fluid 76. The cushioning material 74 forms a liner lining interior surface portions 78 of the flexible bladder 72.

FIG. 8 shows yet another alternative embodiment of a cushioning component 80 having a central chamber 82 and an annular peripheral chamber 84. The annular peripheral chamber 84 is substantially filled with a cushioning material 86. The central chamber 82 has a liner 88 of the cushioning material 86 which is structurally and functionally similar to that shown in FIGS. 4 and 5. In this embodiment, the annular peripheral chamber 84 provides cushioning and shock absorption solely through elastic deformation of the cushioning material 86 since no compressible fluids are present. This embodiment is similar to the embodiment shown in FIGS. 4 and 5 in all other respects.

To make a shoe of the present invention, a midsole is formed having a recess therein, a flexible bladder is placed in the recess, an amount of fluid which is curable to an elastomeric solid condition is placed into an interior volume of the bladder, and the fluid is allowed to cure to the elastomeric solid condition.

Preferably, a predetermined amount of curable fluid is placed into the bladder interior volume through a fill port, such as by injecting, so that the interior volume is partially filled with the curable fluid. For the embodiments shown in FIGS. 4–7, the interior volume of the bladder is filled with an amount of curable fluid sufficient to form a liner of the cured elastomeric solid lining the interior surface portions of the bladder. For these embodiments, the bladder interior volume is only partially filled so as to leave room for the compressible fluid.

As discussed above, the embodiment shown in FIG. 8 includes a central chamber 82 and an annular peripheral chamber 84. For this embodiment, the annular peripheral chamber 84 is substantially filled with the curable fluid so that the cured elastomeric solid 86 occupies substantially the entire interior volume annular peripheral chamber 84. Similar to the embodiments of FIGS. 4–7, the central chamber 82 of this embodiment is filled with an amount of curable fluid sufficient to form a liner 88 of the cured elastomeric solid.

Once the curable fluid has been injected into the interior volume of the bladder, it will tend to settle to the bottom portions of the bladder interior volume due to gravity. After the curable fluid has been injected, the fill port is sealed. Then, the bladder is moved to allow the curable fluid to flow along the interior surface portions of the bladder. Preferably, the viscosity of the curable fluid is sufficiently high so that, even before curing, the fluid will tend to coat the interior surface portions of the bladder due to surface tension. Movement of the bladder may be accomplished by mounting the bladder to a device which slowly but continuously rotates the bladder about at least one axis of rotation. This slow but continuous rotation of the bladder is maintained for a time sufficient to allow the curable fluid to cure, thereby forming a liner 88 of cured elastomeric solid cushioning material along the interior surface portions of the bladder.

In an alterative method, the bladder is turned at predetermined time intervals, rather than being turned continuously. After the curable fluid has been settled in the bottom portions of the bladder interior volume for a predetermined amount of time, a portion of the curable fluid will have cured along the bottom portions of the bladder. Then, the bladder may be turned to allow the remainder of the uncured fluid to flow, by gravity, in order to coat other portions of the bladder. This process is repeated at predetermined time intervals until substantially all of the curable fluid has cured to an elastomeric solid condition in the form of a liner 88 which lines the interior surface portions of the bladder. The time intervals will vary depending on, among other things, the mixing ratio of the polymer and catalyst used to develop the curable fluid.

In another alternative method, the bladder is formed by rotational molding. In other words, the partially filled bladder placed in a three-dimensional centrifuge that rotates the bladder and its contents at high speeds in three dimensions. The high speed rotating, or "spinning" of the bladder in the centrifuge forces the curable fluid against the interior surface portions of the bladder and lines the interior surface portions with the curable fluid. The spinning continues for a time sufficient to allow the curable fluid to cure to a solid elastomeric condition lining the internal surface portions of the bladder.

In view of the above, it will be seen that the several objects of the invention are achieved and other advantageous results attained.

As various changes could be made in the above constructions and methods without departing from the scope of the invention, it is intended that all matter contained in the above description or shown in the accompanying drawings shall be interpreted as illustrative and not in a limiting sense.

What is claimed is:

1. A shoe comprising:

a sole having a recess therein;

a flexible bladder in the recess of the sole, the flexible bladder having interior surface portions defining at least one chamber, the chamber including a first region and a second region, the flexible bladder being generally impervious to gases; and a cushioning material formed from a curable fluid which has cured to an elastomeric solid condition, the cushioning material being elastically deformable but generally incompressible, the cushioning material occupying at least the first region of the chamber.

2. The shoe of claim 1 wherein said chamber is a closed chamber and said second region is occupied by a compressible fluid.

3. The shoe of claim 2 wherein the cushioning material and the compressible fluid are positioned within the chamber so that the compressible fluid provides a primary elastic response to an external pressure applied to an external surface of the bladder through compression of the compressible fluid and the cushioning material provides a secondary elastic response to the external pressure applied to the external surface of the bladder.

4. The shoe of claim 2 wherein said compressible fluid is air.

5. The shoe of claim 2 wherein said cushioning material has an inner surface completely closing the second region.

6. The shoe of claim 2 wherein said cushioning material lines said interior surface portions and envelops the second region.

7. The shoe of claim 6 wherein the cushioning material lining the interior surface portions of the bladder has a thickness of between about 0.5 to about 1.5 millimeters.

8. The shoe of claim 1 wherein the cushioning material is formed from a curable liquid polyurethane which has cured to an elastomeric solid condition.

9. The shoe of claim 1 wherein the cushioning material has a durometer hardness of between about 45 Shore 000 and 55 Shore 000.

10. The shoe of claim 1 wherein said bladder includes top and bottom walls, and wherein said bladder has a plurality of chambers defined by welds connecting portions of the top and bottom walls.

11. A shoe comprising:

a sole having a recess therein;

a flexible bladder in the recess of the sole, the flexible bladder having interior surface portions defining at least one chamber, and a liner of cushioning material lining the interior surface portions of the bladder in a manner to completely envelope at least one cavity within the bladder, the liner of cushioning material being elastically deformable but generally incompressible.

12. The shoe of claim 11 wherein said cavity is occupied by a compressible fluid.

13. The shoe of claim 12 wherein said compressible fluid is air.

14. The shoe of claim 11 wherein the liner of cushioning material is formed from a curable liquid polyurethane which has cured to an elastomeric solid condition.

15. The shoe of claim 11 wherein said bladder includes top and bottom walls, and wherein said bladder has a plurality of chambers defined by welds connecting portions of the top and bottom walls.

16. A shoe comprising:

a sole having a recess therein;

a flexible bladder in the recess of the sole, the flexible bladder being generally impervious to gases, the flexible bladder having interior surface portions defining at least one chamber, the chamber including a first region and a second region;

a cushioning material occupying the first region, the cushioning material being elastically deformable but generally incompressible; and a compressible fluid occupying the second region;

the cushioning material and the compressible fluid being configured so that the compressible fluid provides a primary elastic response to an external pressure applied to an external surface of the bladder through compression of the compressible fluid, and the cushioning material provides a secondary elastic response to the external pressure applied to the external surface of the bladder.

17. The shoe of claim 16 wherein the cushioning material and the compressible fluid are configured so that the compressible fluid provides a first degree of elastic response to a first degree of external pressure applied to the external surface of the bladder through compression of the compressible fluid, and the cushioning material provides a second degree of elastic response to a second degree of external pressure applied to the external surface of the bladder, where the second degree of external pressure is greater than the first degree of external pressure.

18. The shoe of claim 17 wherein the cushioning material forms a liner lining the interior surface portions of said bladder, the liner of cushioning material having an inner surface, the liner of cushioning material lining the interior surface portions of the bladder in a manner so that the inner surface of the cushioning material completely envelopes the second region.

19. The shoe of claim 18 wherein said bladder includes opposed top and bottom walls and said liner includes opposed top and bottom portions lining the top and bottom walls of the bladder, said liner being configured to provide the second elastic response when said opposed top and bottom portions of the liner come into contact with one another.

* * * * *